US006436217B1

(12) United States Patent
Heertjes

(10) Patent No.: US 6,436,217 B1
(45) Date of Patent: Aug. 20, 2002

(54) METHOD FOR FORMING A SCORE IN A STRIP OF LAMINATE

(75) Inventor: Johannes Heertjes, Nuenen (NL)

(73) Assignee: Scanilec B.V., Nuenen (NL)

( * ) Notice: Subject to any disclaimer, the term of this patent is extended or adjusted under 35 U.S.C. 154(b) by 0 days.

(21) Appl. No.: 09/213,750

(22) Filed: Dec. 17, 1998

(30) Foreign Application Priority Data

Dec. 18, 1997 (NL) ..... 1007831

(51) Int. Cl.[7] ..... B31F 1/22

(52) U.S. Cl. ..... 156/206; 156/204; 156/227; 493/396; 493/397

(58) Field of Search ..... 156/196, 200, 156/219, 220, 221, 222, 226, 227, 304.1, 199, 204, 206; 229/198.3, 199, 198.2; 493/121, 160, 162, 183, 396, 397, 52, 395; 428/157, 172, 116

(56) References Cited

U.S. PATENT DOCUMENTS

| | | | | | |
|---|---|---|---|---|---|
| 3,039,372 | A | | 2/1962 | La Bombard | |
| 3,615,149 | A | * | 10/1971 | Malone et al. | 138/118 |
| 3,757,559 | A | * | 9/1973 | Welsh | 72/379 |
| 3,852,138 | A | | 12/1974 | Deuel | |
| 3,866,523 | A | * | 2/1975 | Geschwender | 493/18 |
| 4,064,206 | A | * | 12/1977 | Seufert | 72/379 |
| 4,263,076 | A | * | 4/1981 | Saul | 156/194 |
| 5,175,041 | A | * | 12/1992 | Webb et al. | 428/116 |
| 5,389,059 | A | * | 2/1995 | Corwin | 493/355 |
| 5,511,667 | A | * | 4/1996 | Carder | 206/586 |
| 5,540,972 | A | * | 7/1996 | Jaegers et al. | 428/116 |
| 5,913,766 | A | * | 6/1999 | Reed et al. | 493/464 |

FOREIGN PATENT DOCUMENTS

| | | | | |
|---|---|---|---|---|
| DE | 9216121.9 | | 11/1992 | |
| DE | 92 16 121.9 | | 5/1994 | |
| EP | 0353496 | * | 2/1990 | B32B/27/20 |
| FR | 2 370 562 | | 6/1978 | |
| FR | 2370562 | * | 6/1978 | B27M/1/02 |
| GB | 2 025 328 | | 1/1980 | |
| WO | 9703809 | * | 2/1997 | B29C/59/02 |

* cited by examiner

*Primary Examiner*—Michael W. Ball
*Assistant Examiner*—Jessica Rossi
(74) *Attorney, Agent, or Firm*—Lowe Hauptman Gilman & Berner, LLP

(57) ABSTRACT

A method for forming a score in a strip of laminate, such as cardboard, is disclosed. The laminate has a number of pressed-together layers, which are glued together, after which the score is formed in the strip of laminate. The application of glue between the various layers makes the strip of laminate being formed relatively soft. The score is then pressed into the relatively soft strip of laminate. The thickness of the score will be less than that of the strip of laminate. Curing of the laminate then takes place.

7 Claims, 2 Drawing Sheets

METHOD FOR FORMING A SCORE IN A STRIP OF LAMINATE

TECHNICAL FIELD

The invention relates to a method for forming a score in a strip of laminate, for example cardboard, which laminate comprises a number of pressed-together layers glued together, after which the score is formed in the strip of laminate.

The invention also relates to a hinged angle section provided by such a method.

1. Background Art

A method is known from German utility model 9216121.9, in which a number of layers of cardboard are glued together, with no glue being applied at the location of the score to be formed. The score is then pressed into the cardboard strip. After the score has been formed, the layers of cardboard are spaced closer together on either side of the score than at the location of the score. As a result of this the thickness of the cardboard score on either side of the strip is smaller than at the location of the score. One drawback of such a method is the fact that the selective leaving out of glue is relatively laborious, whilst furthermore the intended improved hinge effect is not achieved in practice. As an alternative it is proposed in the utility model to detach the layers from each other near the score by means of an upsetting operation. Such a method is relatively laborious and requires an extreme process control in order to be able to effect the correct degree of upsetting. Also with this method the hinged angle section that is obtained appears is not very satisfactory in practice.

An object of the invention is to provide a method wherein a score can be formed in a strip of laminate in a simple and reliable manner.

2. Disclosure of the Invention

This objective is accomplished with the method according to the invention in that the application of glue between the various layers makes the strip of laminate being formed relatively soft. The score is subsequently pressed into the relatively soft strip of laminate, whereby the thickness of the score will be less than that of the strip of laminate, after which curing of the laminate takes place.

The laminate being formed is softened as a result of the application of glue to the various layers and the heating that may take place, if desired. The material properties of the laminate in this soft condition appear to be ideal for forming a score, so that after subsequent curing of the glue a score is obtained which readily allows bending without causing the various layers of the laminate to break or tear. By forming the score in the laminate when it is relatively soft, the physical properties of the laminate are utilized optimally. Since the layers are pressed closer together at the location of the score than on either side thereof, bending of the strip of laminate is further simplified.

One embodiment of the method according to the invention is characterized in that the strip of laminate is folded into an angle section before the score is formed, whereby the strip of laminate is divided into two parts extending transversely to each other, after which a recess is formed in the first part, and the score is formed in the second part, in a direction transverse to the first part.

In this way a hinged angle section is obtained which allows repeated hinging without the layers of the laminate breaking or tearing thereby.

BRIEF DESCRIPTION OF THE DRAWINGS

The invention will be explained in more detail with reference to the drawings, in which.

BEST MODE FOR CARRYING OUT THE INVENTION

Corresponding parts are indicated by the same numerals in the figures.

Figure 1:
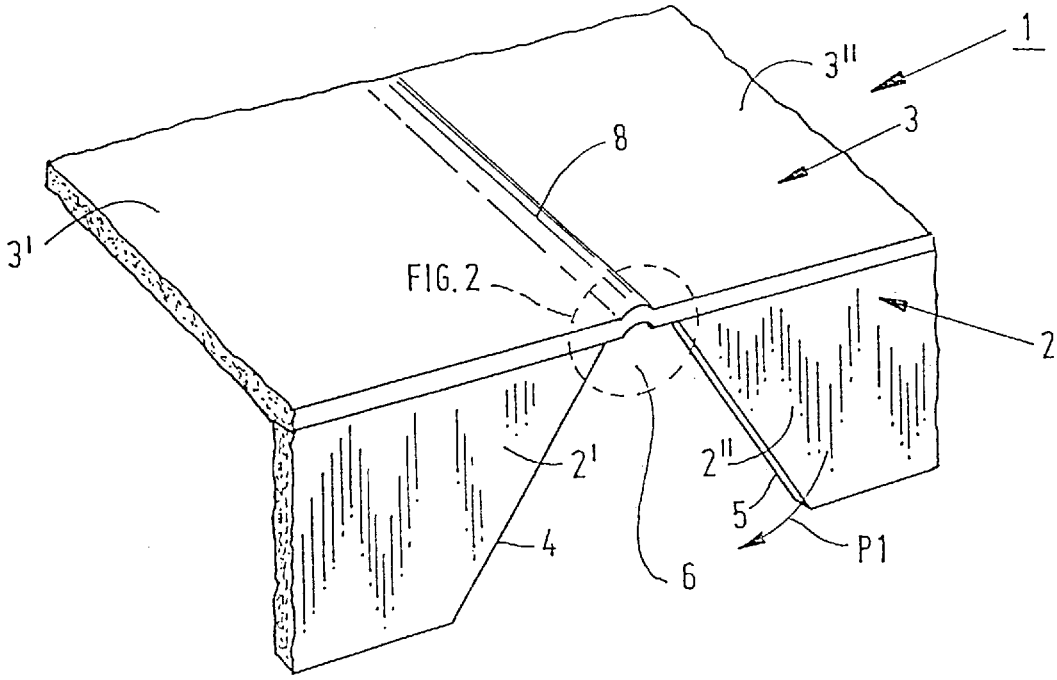
FIG. 1 is a plan view of a hinged angle section according to the invention.
Figure 3A:
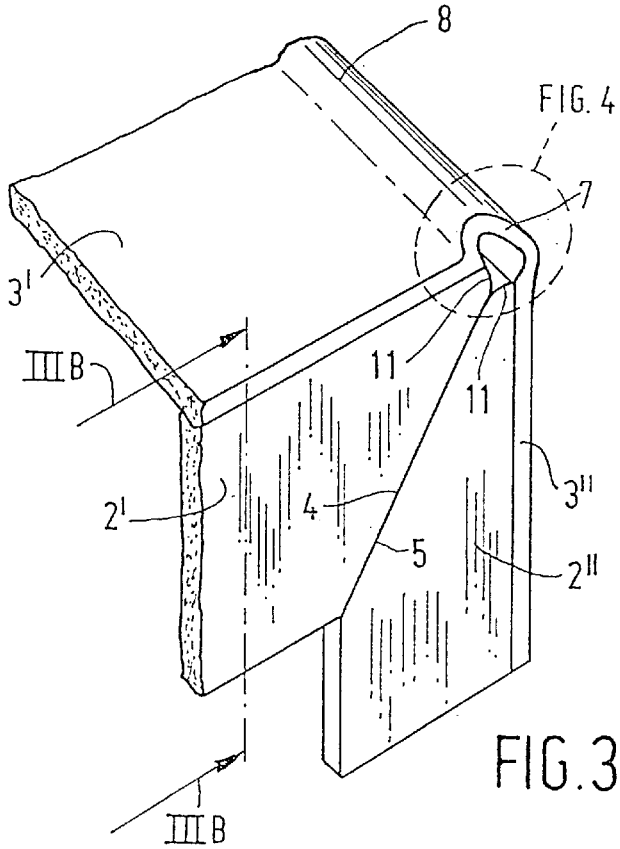
FIGS. 3A, 3B are perspective and side views respectively, in the direction indicated by arrows III—III, of the angle section shown in FIG. 1, wherein said section has been folded at right angles.
Figure 3B:
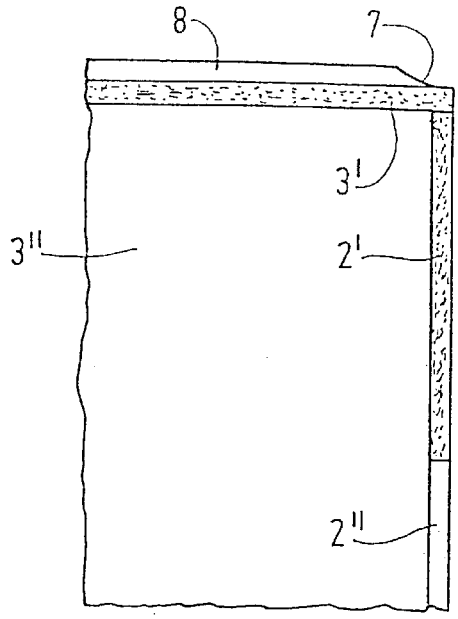

FIG. 1 shows a hinged angle section 1 according to the invention, which comprises two parts 2, 3 extending transversely to each other, whereby first part 2 is provided with a recess 6 which is bounded by edges 4, 5. Edges 4, 5 each form an angle of 45° with second part 3. At the transition between edges 4, 5 and second part 3, second part 3 is provided with a recess 7 (see FIG. 3B). Recess 6 divides first part 2 into two portions 2', 2". Second part 3 is provided with a score 8 centrally between portions 2', 2", which score divides the second part into portion 3', which is contiguous to portion 2', and a portion 3", which is contiguous to portion 2".

Figure 2:
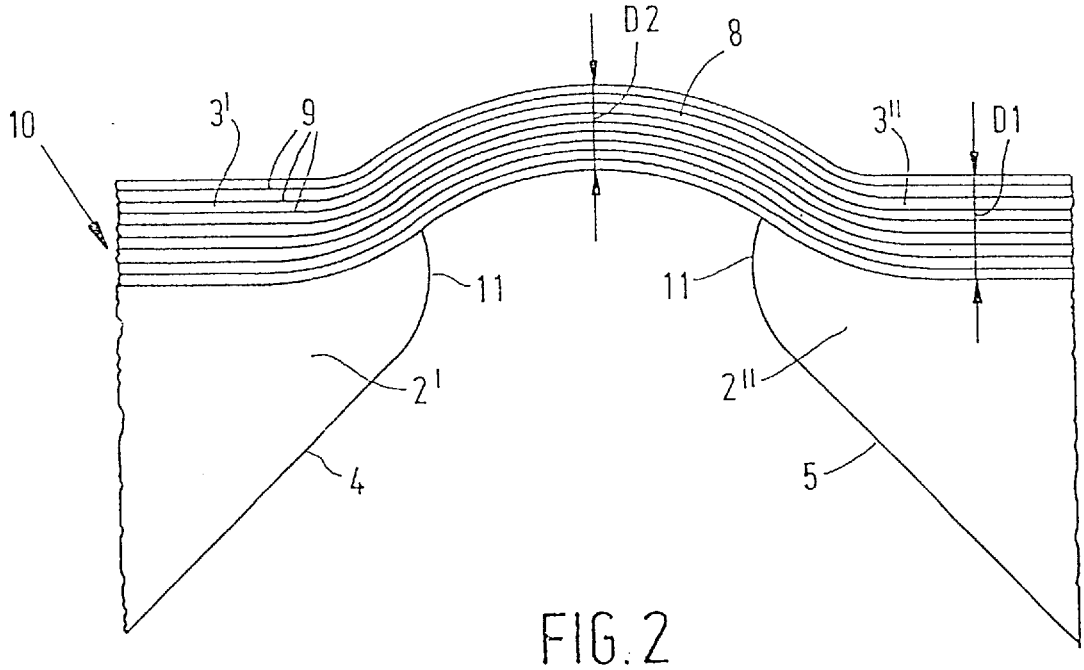
FIG. 2 is an enlarged detail of the hinged angle section illustrated in FIG. 1.

As can be seen in FIG. 2, angle section 1 is made of a laminate 10 built up of cardboard layers 9, whereby thickness D1 at the location of portions 3', 3" is greater than thickness D2 at the location of the score 8 formed in second portion 3.

As can furthermore be seen in FIG. 2, edges 4, 5 of portions 2', 2" are provided with rounded corners 11 near score 8.

The forming of hinged angle section 1 and the movement of hinged angle section 1 will now be discussed in more detail.

Figure 4:
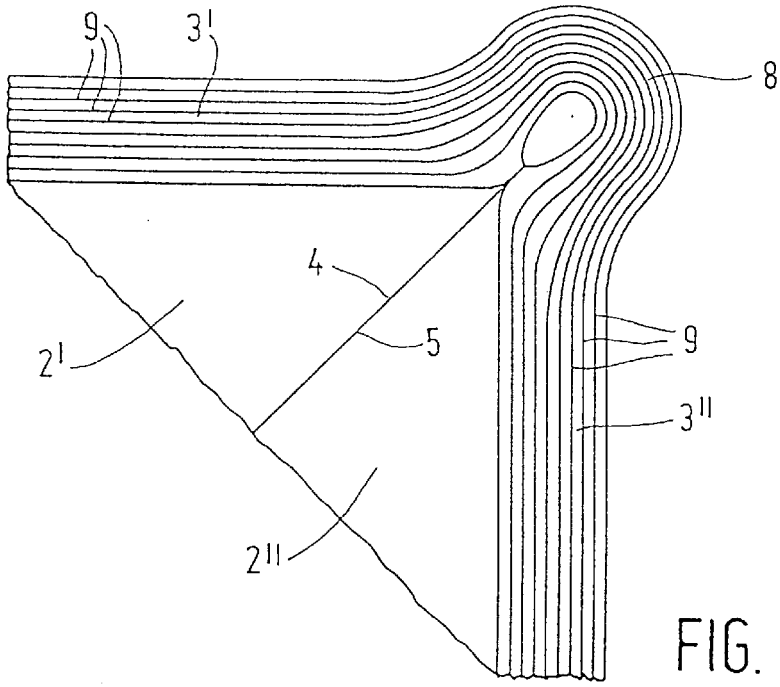
FIG. 4 is an enlarged detail of the folded angle section of FIG. 3A.

A number of rolls of, for example, cardboard layers are placed into a machine, after which these rolls of cardboard layers are unwound and the layers are fed to a gluing station. Glue is then applied to said cardboard layers and the cardboard layers are heated, which results in the cardboard layers becoming soft. The various cardboard layers are now moved together and pressed into an angle section, thereby forming parts 2, 3. Recesses 6, 11 are now formed in the angle sections, which are still soft, and score 8 is pressed into second part 3 without severing the A number of rolls of, for example, cardboard layers are placed into a machine, after which these rolls of cardhoard layers are unwound and the layers are fed to a glueing station. Glue is then applied to said cardboard layers and the cardboard layers are heated, which results in the cardboard layers becoming soft. The various cardboard layers are now moved together and pressed into an angle section, thereby forming parts 2, 3. Recesses 6, 11 are now formed in the angle sections, which are still soft, and score 8 is pressed into second part 3 without severing the cardboard layers as can be seen in, e.g., FIGS. 2 and 4. The soft layers 9 pressed so tightly together at the location of score 8 that, after the glue has cured, the thickness D of score 8 is smaller than the thickness D1 of the portions 3', 3" present on either side of score 8.

After the glue has compleely cured, the angle section 1 may be formed. To this end portions 2", 3" are pivoted in a direction indicated by arrow P1 with respect to portions 2', 3', until edges 4, 5 butt against each other (see FIG. 3A). The cardboard angle section thus formed may be used as a protecting piece during transport of products having vulnerable edges, such as tables and cupboards. The angle section thus formed may also function to strengthen corners of boxes.

In addition to being used for forming hinged angle sections, the method according to the invention may also be used for forming a score in a cardboard sheet.

What is claimed is:

1. A method for forming a foldable score line in a strip of laminate comprising the steps of:

providing a laminate comprising a number of prepressed-together paper layers wherein an adhesive is applied between adjacent layers for bonding said layers together and making the strip of laminate relatively soft;

pressing a score into the softened strip of laminate to form the score line, whereby the strip of laminate is divided into a scored portion containing the score line and unscored portions on either side of the score line ; and curing the scored laminate, said method further including:

folding the strip of laminate into an angle section before the score line is formed whereby the strip of laminate is divided into first and second parts extending transversely to each other;

forming a recess in the first part of the folded strip of laminate; and forming the score line in the second part of the folded strip of laminate in a direction transversely to said first part;

wherein a thickness of the strip of laminate in the scored portion will be less than in the unscored portions when the adhesive is cured.

2. The method of claim 1, comprising the further step of pivoting a first portion of the first part and a first portion of the second part about the score line towards a second portion of the first part and a second portion of the second part until the portions of the first part contact each other to form a hinged angle section.

3. The method of claim 1, wherein the second part of the softened strip of laminate is substantially planar.

4. The method of claim 1, wherein the prepressed-together layers are paper.

5. The method of claim 4, wherein said forming of the score line is performed without severing the layers in the softened strip of laminate.

6. The method of claim 1, wherein the second part of the softened strip of laminate has upper and lower major surfaces, and the score is pressed in the lower surface only.

7. The method of claim 6, further comprising pivoting a first portion of the first part and a first portion of the second part about the score line downward and towards a second portion of the first part and a second portion of the second part until the portions of the first part contact each other to form a hinged angle section.

* * * * *